US009636929B2

(12) United States Patent
Hughes

(10) Patent No.: US 9,636,929 B2
(45) Date of Patent: May 2, 2017

(54) APPARATUS FOR MARKING A LABORATORY SAMPLE CARRIER

(71) Applicants: PYRAMID INNOVATION, Netherfield, Sussex (GB); Thomas Fergus Hughes, Netherfield, Sussex (GB)

(72) Inventor: Thomas Fergus Hughes, Netherfield (GB)

(73) Assignee: PYRAMID INNOVATION (partial interest), Netherfield (GB)

( * ) Notice: Subject to any disclaimer, the term of this patent is extended or adjusted under 35 U.S.C. 154(b) by 0 days.

(21) Appl. No.: 14/907,784

(22) PCT Filed: Aug. 5, 2014

(86) PCT No.: PCT/GB2014/052393

§ 371 (c)(1),
(2) Date: Jan. 26, 2016

(87) PCT Pub. No.: WO2015/019072

PCT Pub. Date: Feb. 12, 2015

(65) Prior Publication Data

US 2016/0185132 A1 Jun. 30, 2016

(30) Foreign Application Priority Data

Aug. 7, 2013 (GB) ..... 1314104.9

(51) Int. Cl.
*B41J 2/15* (2006.01)
*B41J 11/00* (2006.01)
*B41J 3/407* (2006.01)

(52) U.S. Cl.
CPC ..... *B41J 11/0045* (2013.01); *B41J 3/407* (2013.01); *B41J 3/4073* (2013.01)

(58) Field of Classification Search
CPC .... B41J 2/2142; B41J 2/0451; B41J 2/16579; B41J 2/01; B41J 2/2139;
(Continued)

(56) References Cited

U.S. PATENT DOCUMENTS

| | | | |
|---|---|---|---|
| 5,893,263 | A | 4/1999 | Matsumoto et al. |
| 2002/0167577 | A1 | 11/2002 | Kiene |
| 2003/0059281 | A1 | 3/2003 | Kiene et al. |

FOREIGN PATENT DOCUMENTS

| | | | |
|---|---|---|---|
| GB | 2 235 163 | A | 2/1991 |
| WO | WO 2007/135396 | A1 | 11/2007 |

OTHER PUBLICATIONS

PCT/GB2014/052393 International Search Report and Written Opinion.
GB 1314104.9 Search Report under Section 17.

*Primary Examiner* — Lamson Nguyen
(74) *Attorney, Agent, or Firm* — Fay Sharpe LLP

(57) ABSTRACT

An apparatus (1) for marking a laboratory sample carrier (2), includes a guide (5) configured to guide a sample carrier (2) from an entry location (6) to an exit location (7), and a print head (23) configured and positioned to mark a sample carrier (2) at a marking location (24) at a guide position intermediate the entry and exit locations (6, 7). The guide (5) is inclined such that a laboratory sample carrier (2) can travel from the entry to the exit locations (6, 7) under the influence of gravity. The apparatus (1) further includes a selectively deployable stop (41) for arresting the travel of a sample carrier (2) down the guide (5) at the marking location (24), the stop (41) being undeployable to allow the sample carrier (2) to travel from the marking location (24) to the exit location (7).

20 Claims, 12 Drawing Sheets

APPARATUS FOR MARKING A LABORATORY SAMPLE CARRIER

The present invention relates to an apparatus for marking a laboratory sample carrier having a marking or writing surface wherein the carrier may be a laboratory slide or phial or vial.

Printers for printing on or marking laboratory sample carriers grip or clamp the sample carriers to move them through the printing mechanism of the printer. A problem with these printers is that the sample carriers may be damaged by the stress of being gripped or clamped to move them through the printing mechanism.

It is an object of the present invention to provide an apparatus for marking laboratory sample carriers to alleviate the above-mentioned problem.

According to the present invention there is provided an apparatus for marking a laboratory sample carrier, including (i) a guide means configured to guide a sample carrier from an entry location to an exit location; and (ii) a marking means configured and positioned to mark a sample carrier at a marking location at a guide means position intermediate the entry and exit locations, wherein the guide means is vertical or inclined such that a sample carrier can travel from the entry to the exit locations under the influence of gravity and the apparatus further includes selectively deployable first stop means for arresting the travel of a sample carrier down the guide means at the marking location, the first stop means being undeployable to allow the sample carrier to travel from the marking location to the exit location.

By making use of gravity, the apparatus enables a laboratory sample carrier to be marked without the need to grip or clamp the sample carrier to move it through the printing mechanism of the printer so that the sample carrier avoids the stress generated by this. This also enables a laboratory sample carrier to be moved quickly through the apparatus.

Laboratory sample carriers can be dropped into the apparatus by hand or by a mechanical delivery unit.

The apparatus may include first stop means biasing means for biasing the first stop means to a deployed position.

The apparatus may include selectively deployable second stop means for stopping the travel of a laboratory sample carrier from the entry location to the marking location, the second stop means being undeployable to allow the sample carrier to travel to the marking location. The apparatus may include second stop means biasing means for biasing the second stop means to a deployed position.

The apparatus may include marking means biasing means for biasing the marking means towards the marking location. The apparatus may include an actuator arranged to counter the marking means biasing means to move the marking means away from the marking location.

The apparatus preferably includes translating means arranged to move the marking means in a first direction towards or away from the marking location.

The apparatus preferably includes moving means arranged to move the marking means in a second direction along the guide means transversely to the first direction. The moving means may be arranged to undeploy the first stop means. The moving means may be arranged to undeploy the second stop means.

The apparatus may include a carriage to which the marking means is mounted. There may be provided means to undeploy at least one said stop means mounted to move with the carriage.

The apparatus may include selectively deployable sample carrier holding means for holding a laboratory sample carrier at the marking location. The sample carrier holding means may comprise a pair of sample carrier holding portions arranged to be deployed by being rotated towards the marking location and arranged to be undeployed by being rotated away from the marking location. The first stop means preferably comprises part of the sample carrier holding means. The translating means may be arranged to deploy the sample carrier holding means.

The sample carrier holding means may include means for rotating the laboratory sample carrier at the marking location. This is useful when the laboratory sample carrier is a phial. The sample carrier holding means rotating means may be arranged to rotate the laboratory sample carrier when the marking means is positioned to mark the laboratory sample carrier. The marking means is preferably stationary when the laboratory sample carrier is rotated to be marked.

The apparatus may include first sensing means for sensing that a said laboratory sample carrier has entered the apparatus.

The apparatus may include second sensing means for sensing that the laboratory sample carrier has been placed in the correct orientation at the marking location. The first stop means may be arranged to be undeployed when the second sensing means senses that the laboratory sample carrier has been placed in an incorrect orientation at the marking location. The second sensing means may comprise an optical sensor suitable for sensing a beam of light passing through a transparent body of a laboratory sample carrier such as a laboratory slide.

The apparatus may include a laboratory sample carrier reader for reading marking on the sample carrier. The sample carrier reader may be positioned to read marking on the sample carrier when the sample carrier travels from the marking location. Thus, if a barcode is printed by the marking means on the sample carrier, the reader can be used to verify the barcode printed.

The apparatus may include means for positioning tape between the marking means and the marking location. The tape is preferably a thermal or foil tape. A roll of the tape may be mounted on a biased arm that moves as the size of the roll decreases, the apparatus including arm sensing means for sensing movement of the biased arm as the roll changes in size. This enables the amount of tape left to be monitored.

The marking means may comprise a plurality of wires with ends arranged substantially parallel and adjacent to each other. The marking means may be arranged to heat a selected number of said wires to mark the laboratory sample carrier. The controlling means may control the amount of heat applied to any said wire taking into account calculated residual heat of said wire. By making use of the residual heat of a wire, less time and power is required to use the wire again. Print quality is improved by controlling the time and power of the heat applied to the wires.

Embodiments of the present invention will now be described, by way of example, with reference to the accompanying schematic drawings, in which.

Figure 9:
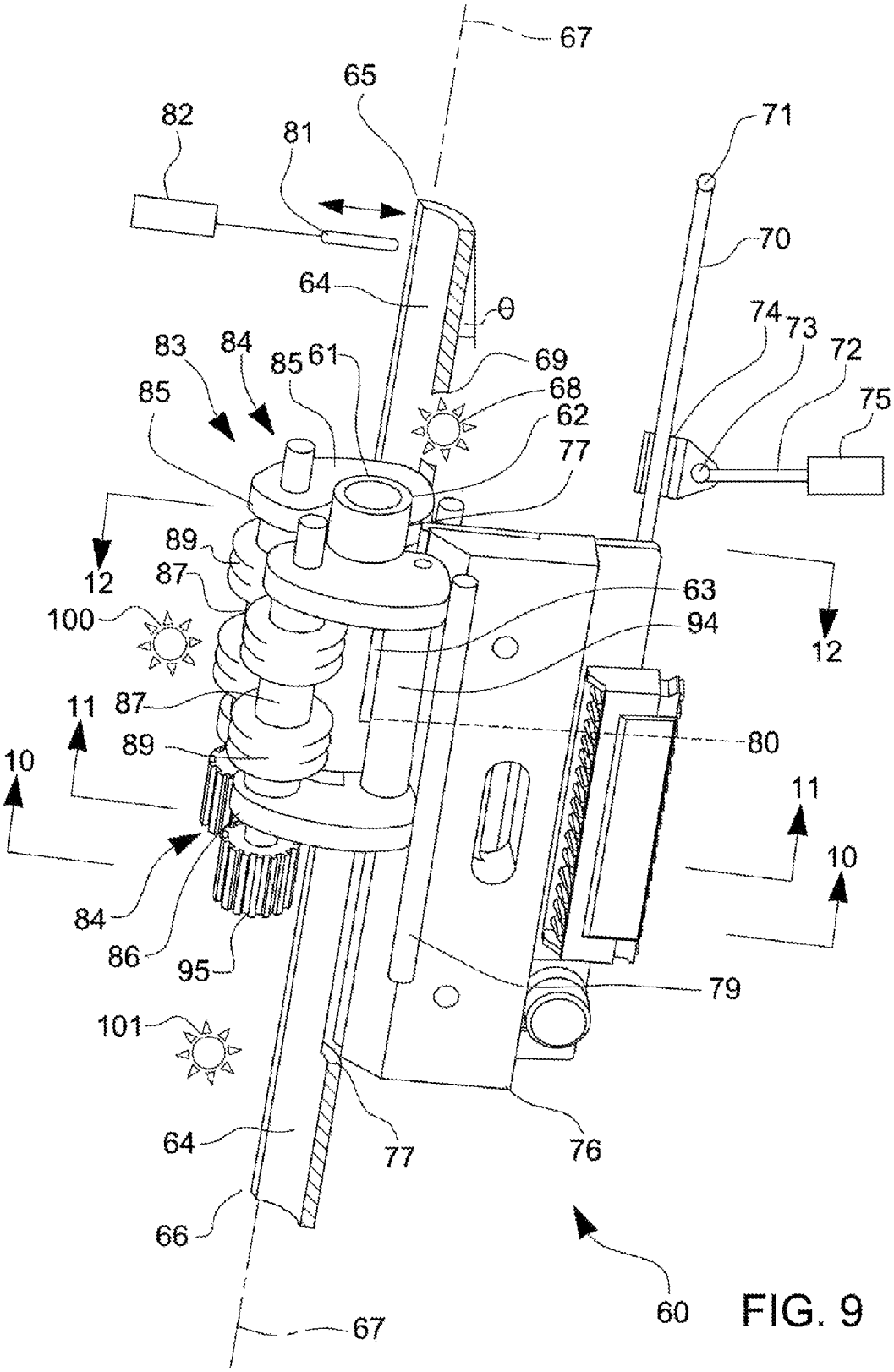
FIG. 9 is a perspective view of the printing mechanism of an apparatus for marking a laboratory sample carrier according to a second embodiment of the invention, the laboratory sample carrier being in the form of a phial.
Figure 10:
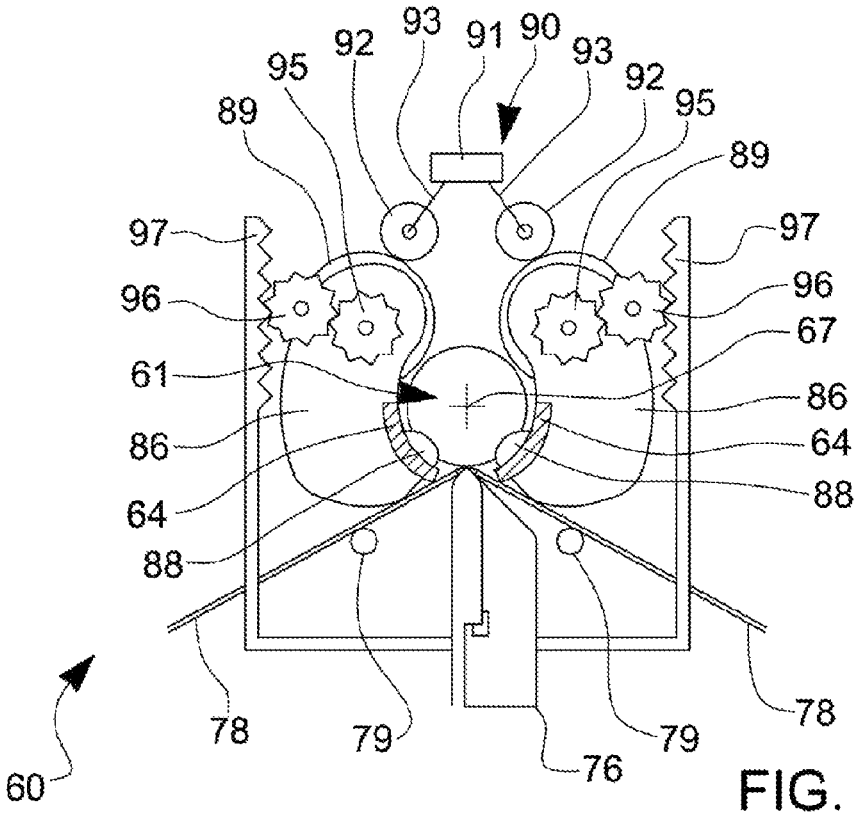
Figure 11:
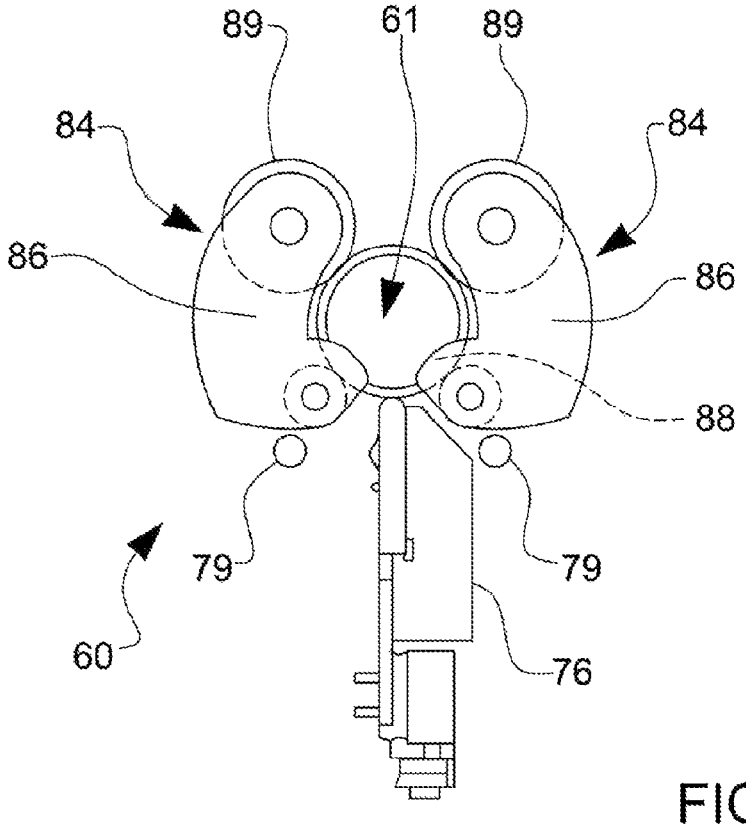
Figure 12:
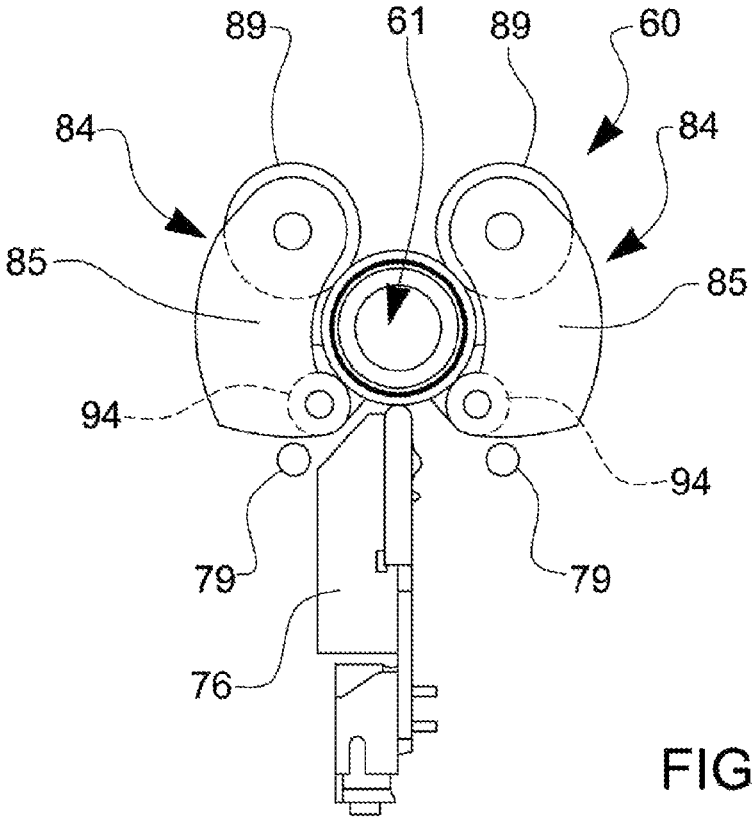
Figure 13:
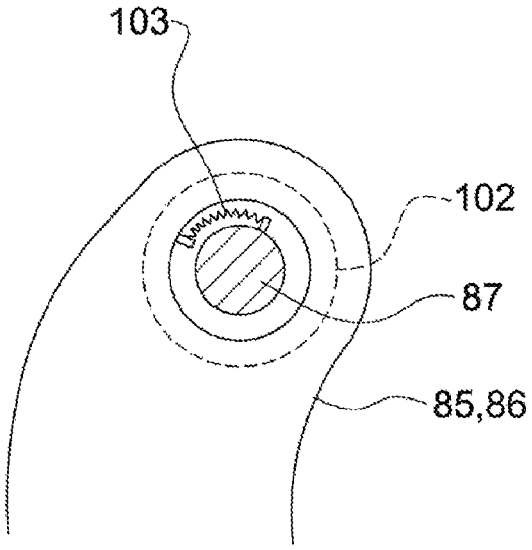
Figure 14:
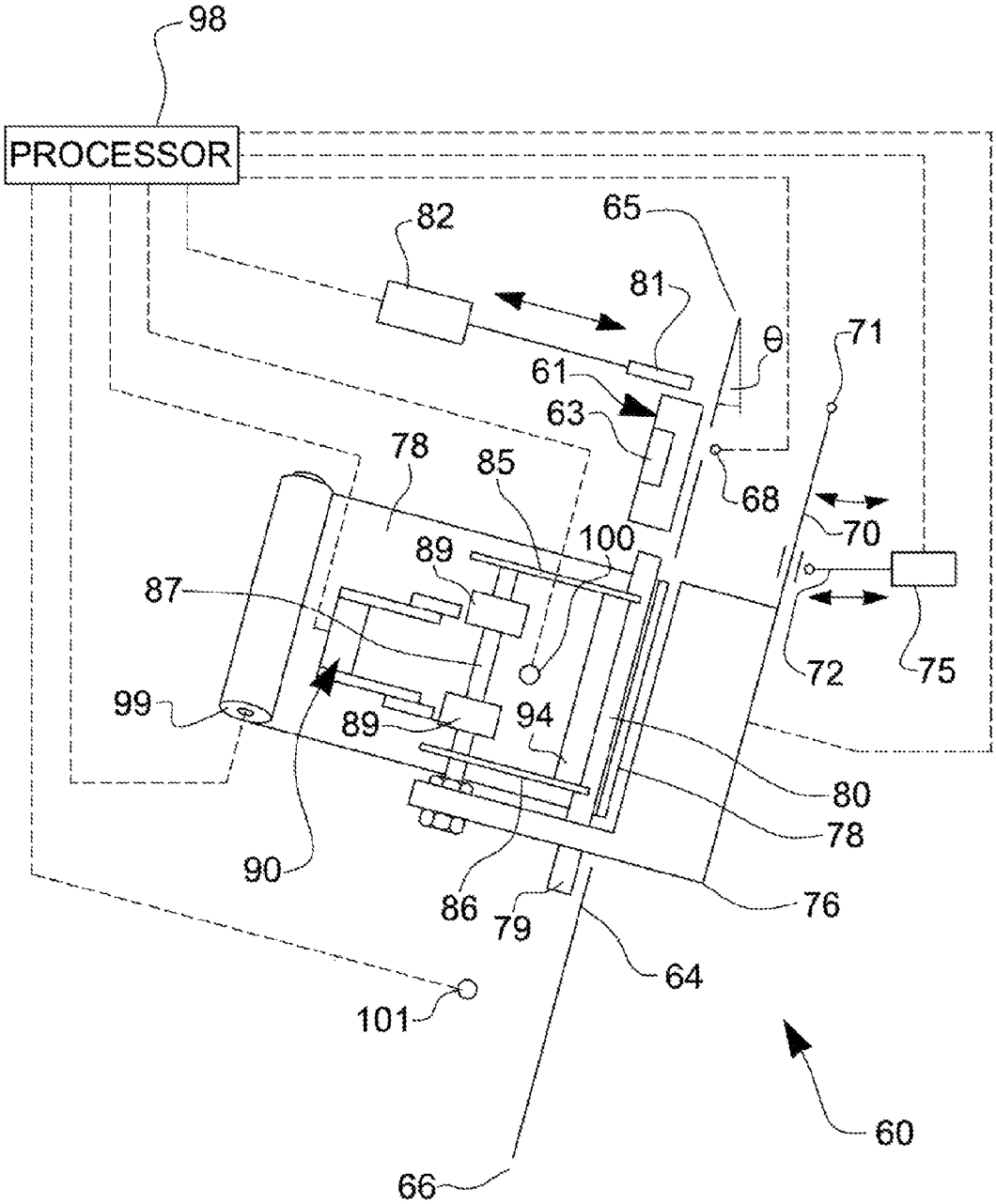
Figure 15:
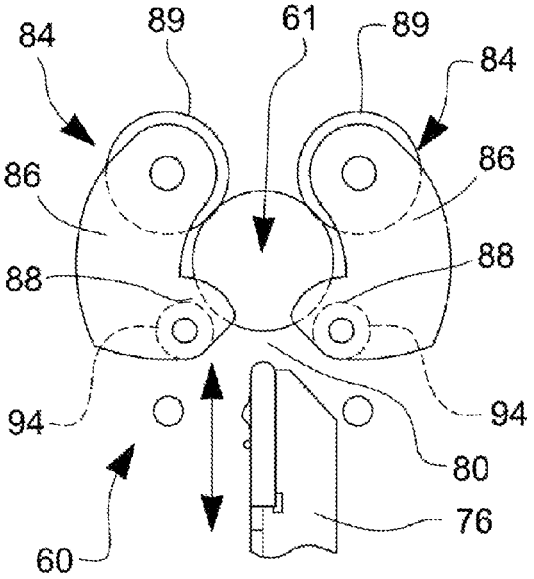
Figure 16:
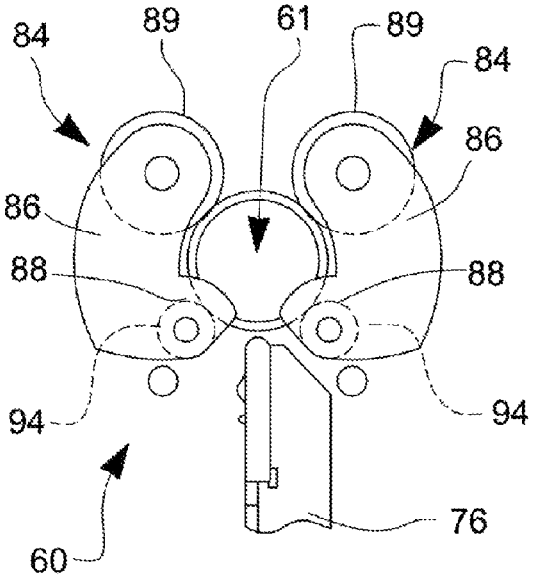
Figure 17:
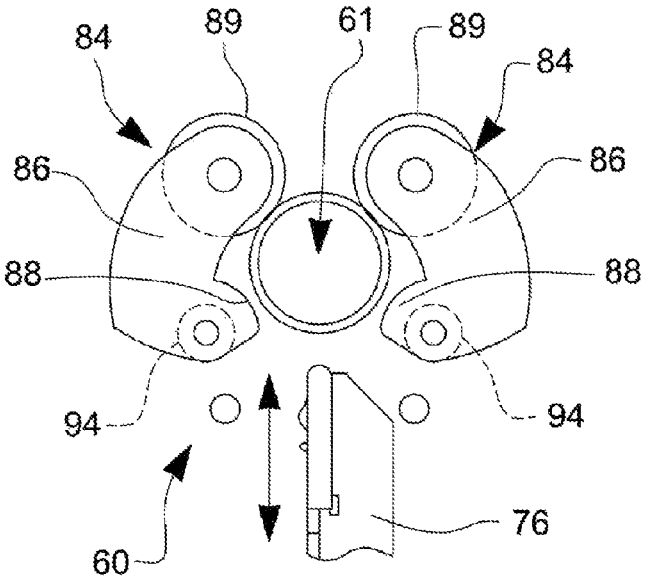

FIGS. 10, 11 and 12 are sectional views taken along lines 10-10, 11-11 and 12-12, respectively, of FIG. 9;

FIG. 13 is a detail of a connection between an arm and an axle of a phial holding portion of the printing mechanism of FIG. 9;

FIG. 14 is a view of the apparatus of FIG. 9 showing a control processor; and FIGS. 15, 16 and 17 are sectional views similar to FIG. 11 with the print mechanism shown in a rest position, a patch location position, and an eject position, respectively.

Referring to FIGS. 1 and 2 and FIGS. 6 to 8 of the accompanying drawings, an apparatus or printing mechanism 1 for marking a laboratory sample carrier 2 according to a first embodiment of the invention is illustrated. The laboratory sample carrier is a laboratory or microscope slide 2 wherein the laboratory slide 2 has a transparent body 3 (which may be of glass) and a marking surface or writing patch 4 painted at an end portion of a major surface of the transparent body 3. The apparatus 1 has a guide 5 configured to guide a slide from an entry location 6 to an exit location 7. The guide 5 has a surface 8 inclined at a steep angle such that a slide 2 can travel from the entry location 6 to the exit location 7 under the influence of gravity but without tipping forward. The surface 8 is inclined at an angle θ shown in FIG. 6 of approximately 15° to the vertical. The angle θ is preferably in the range 5° to 25° and more preferably in the range 10° to 20°. Shoulders 9 on opposite sides of the inclined surface 8 are used to guide the slide 2 down the surface 8. A cap 10 can be placed over the entry location 6 when the apparatus 1 is not in use.

On the opposite side of the guide 5 to the inclined surface 8 is a linear bearing rail 11 on which is mounted a carriage block 12. The carriage block 12 is moved along the rail 11 by a belt 13 driven by a stepper motor 14 so that the carriage block 12 can be moved back and forth in a direction 15 along the guide 5.

Figure 6:
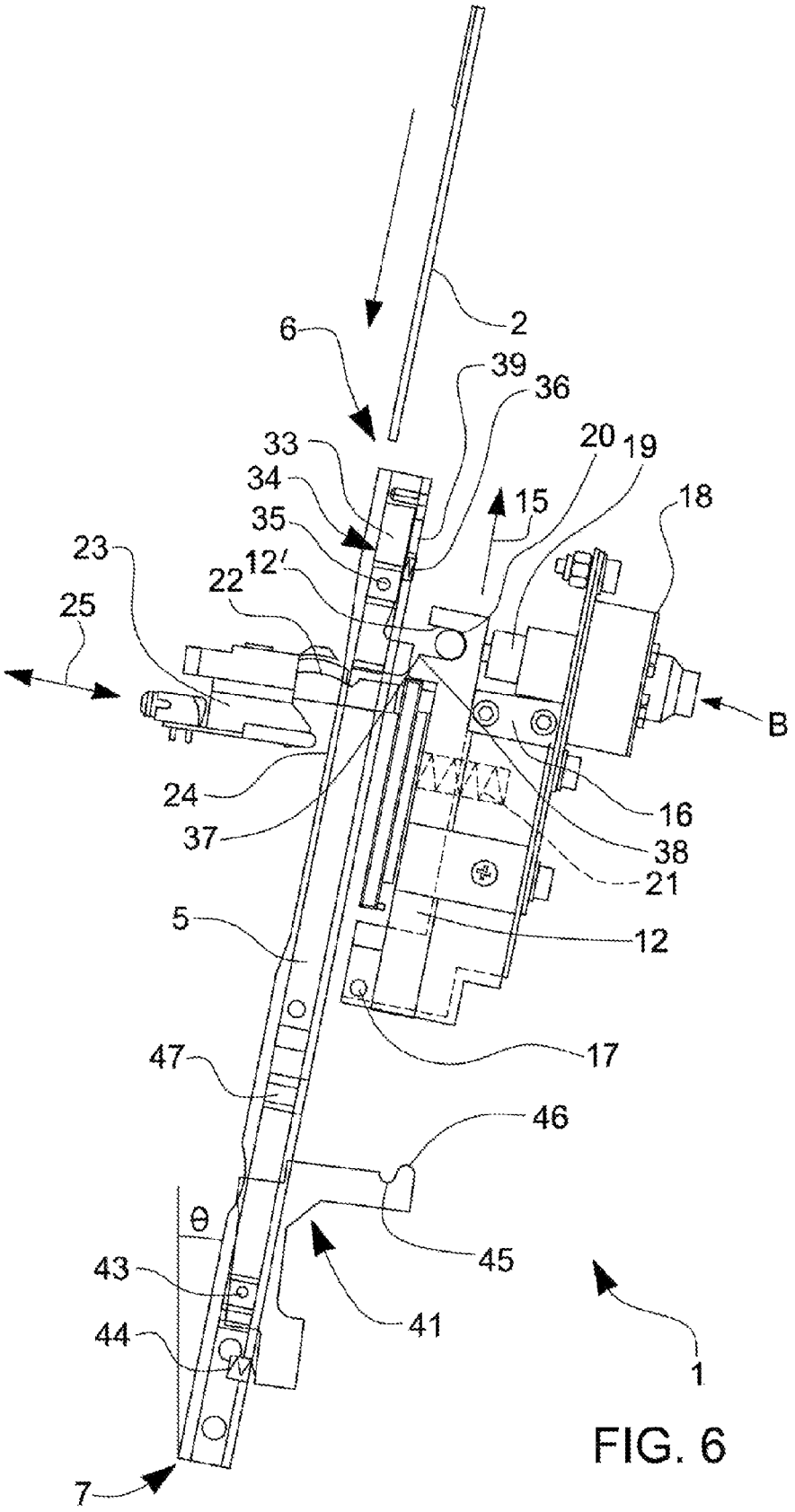
FIG. 6 is a view of the printing mechanism when a laboratory slide is to be loaded into the mechanism.
Figure 7:
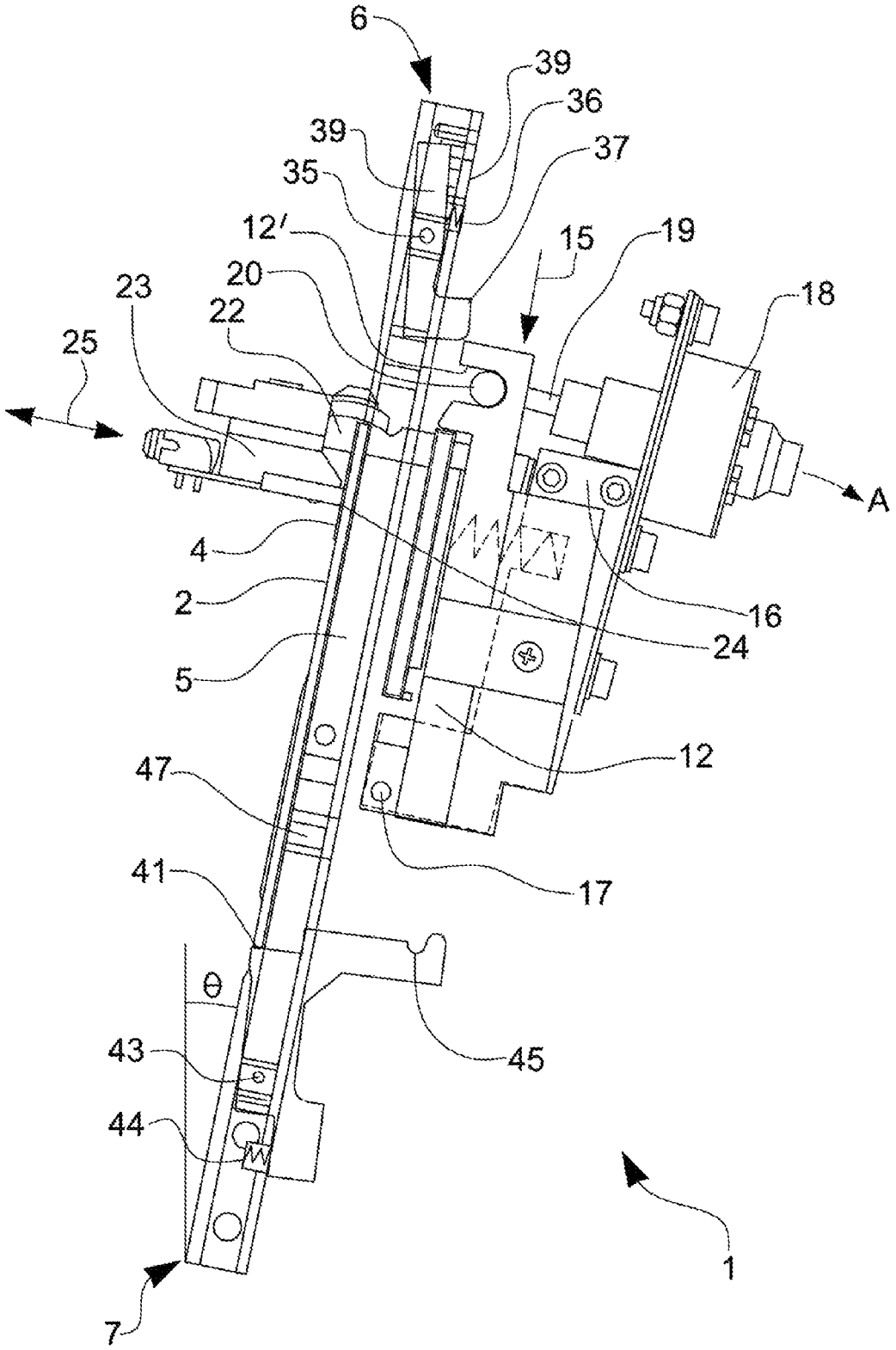
FIG. 7 is a view of the printing mechanism in its slide printing position.
Figure 8:
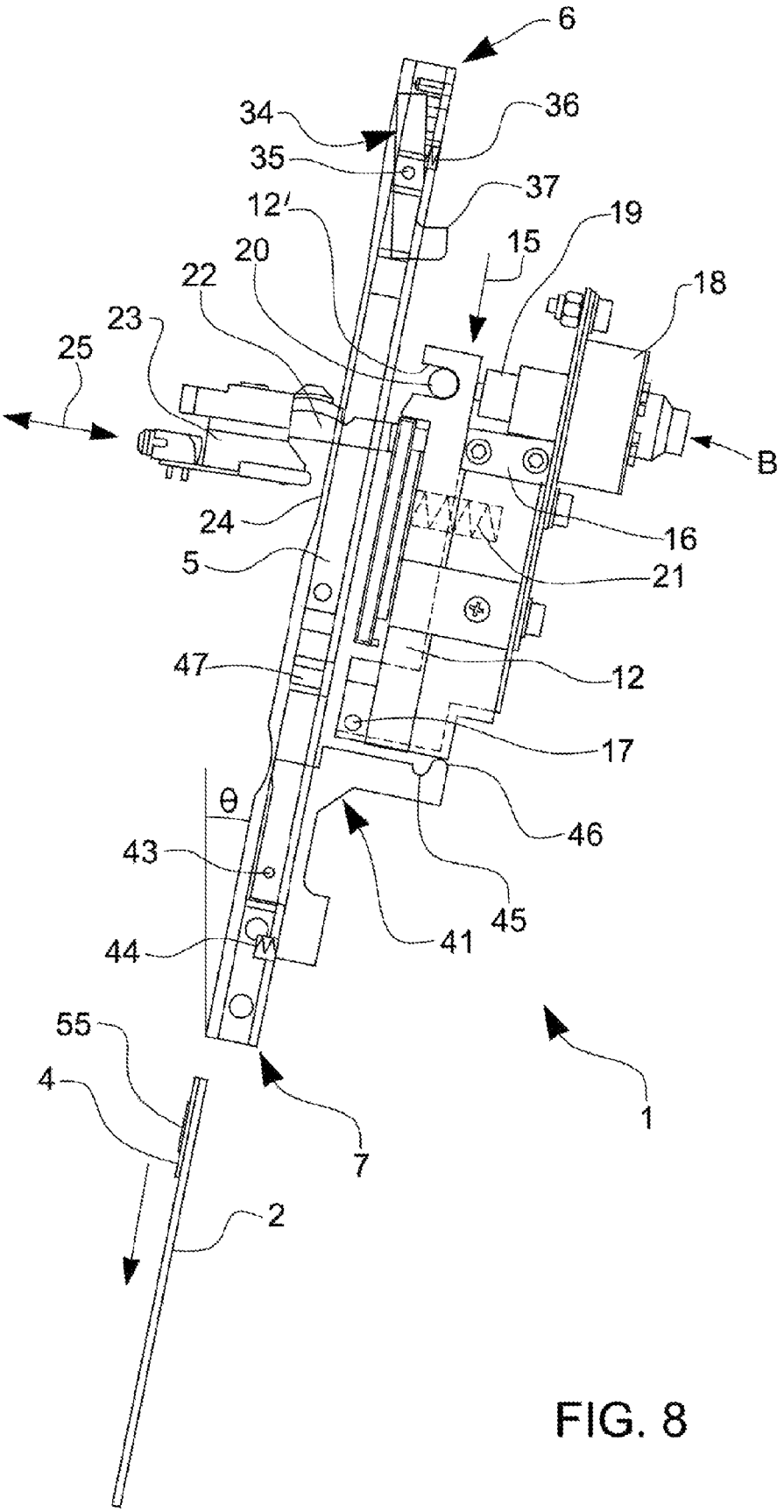
FIG. 8 is a view of the printing mechanism when the laboratory slide is ejected from the mechanism.

A pivot arm 16 is mounted on the carriage block 12 and is arranged to pivot about a pivot point 17 at one end of the carriage block 12. The distal end of the pivot arm 16 has a stepper motor 18 which actuates a linear actuator shaft 19. FIG. 7 shows the pivot arm 16 and stepper motor 18 pivoted in the direction of arrow A away from the opposite side of the guide 5. FIGS. 6 and 8 show the pivot arm 16 and stepper motor 18 pivoted in the direction of arrow B towards the opposite side of the guide 5. The distal end of the shaft 19 is connected to the carriage block 12 by a pivot connection in the form of a T-shaped piece 20 at the end of the shaft 19 being accommodated in a U-shaped slot 12' in the carriage block 12. A spring 21 (shown in dashed lines in FIGS. 6, 7 and 8) is mounted between the carriage block 12 and the pivot arm 16. The spring 21 is adjacent the shaft 19. The spring 21 biases the pivot arm 16 to rotate away from the carriage block 12. When the shaft 19 is in a retracted position, as shown in FIGS. 6 and 8, the spring 21 is compressed and the pivot arm 16 and stepper motor 18 are moved in the direction of arrow B.

Adjacent the actuator shaft 19, a print head mount or sledge 22 extends from the pivot arm 16 around the guide 5 so that a print head 23 mounted at the end of the mount 22 faces the inclined surface 8 of the guide 5. The print head 23 is configured and positioned to mark a laboratory slide 5 at a marking location or slide platform print area 24 at a guide position intermediate the entry location 6 and the exit location 7. The arrangement of the pivot arm 16, stepper motor 18, linear actuator shaft 19 and print head mount 22 comprises translating means to move the print head 23 back and forth in a direction 25 (first direction) transversely to the direction 15 (second direction) of the carriage block 12 along the guide 5.

Figure 1:
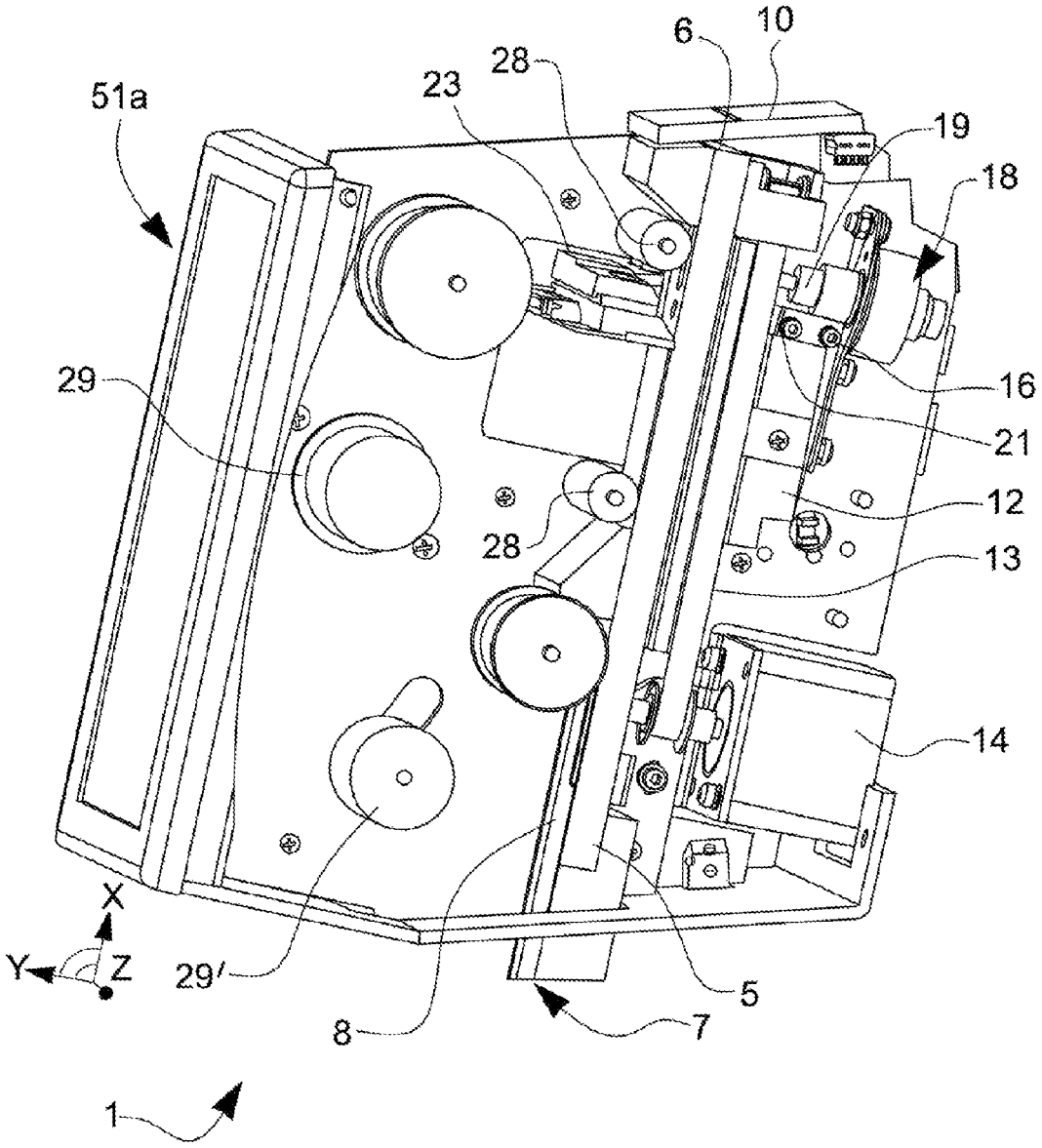
FIG. 1 is a perspective view of an apparatus comprising a printing mechanism for marking a laboratory sample carrier according to a first embodiment of the invention cut away to show internal features, the laboratory sample carrier being in the form of a laboratory slide.
Figure 2:
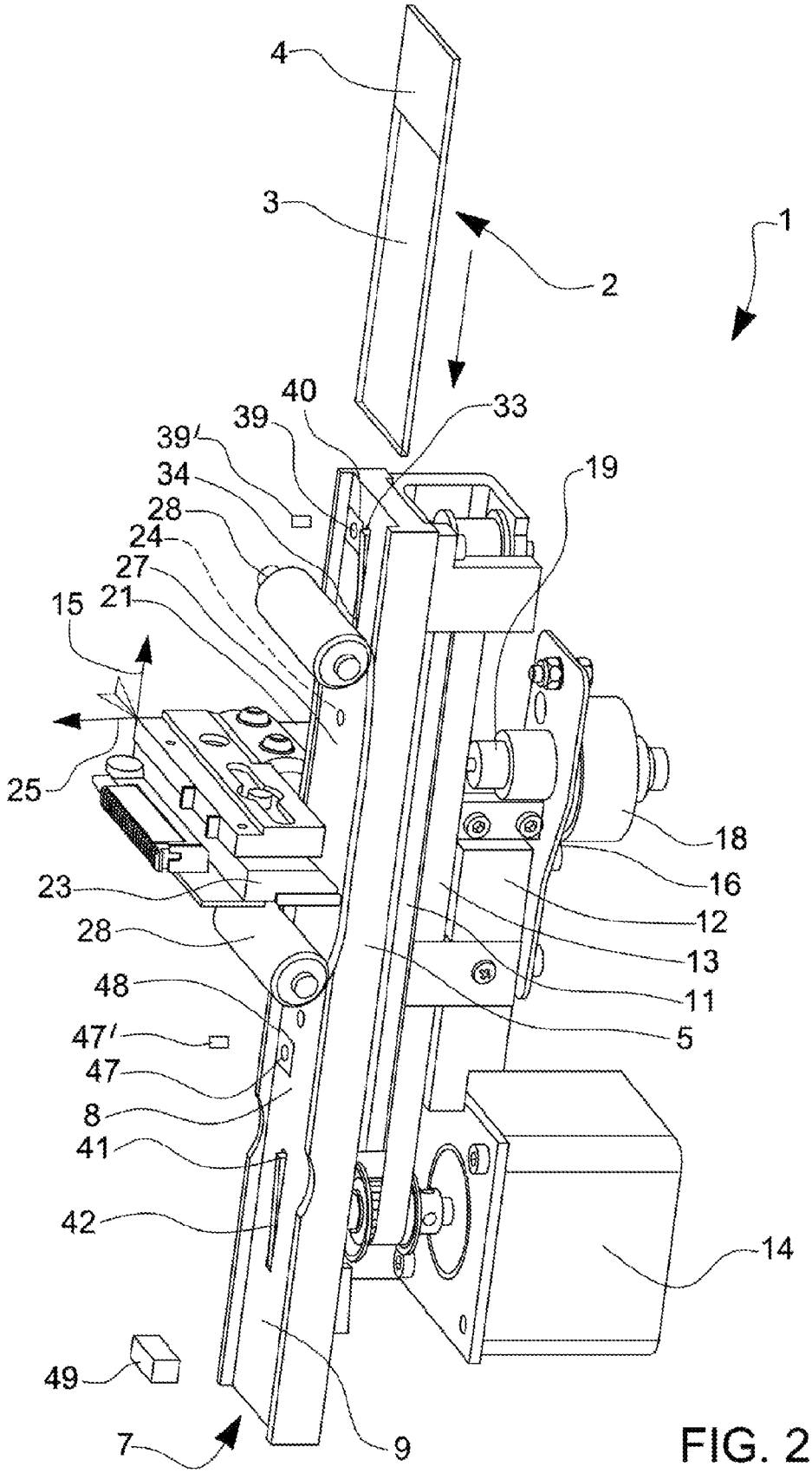
FIG. 2 is a perspective view of the printing mechanism.
Figure 3:
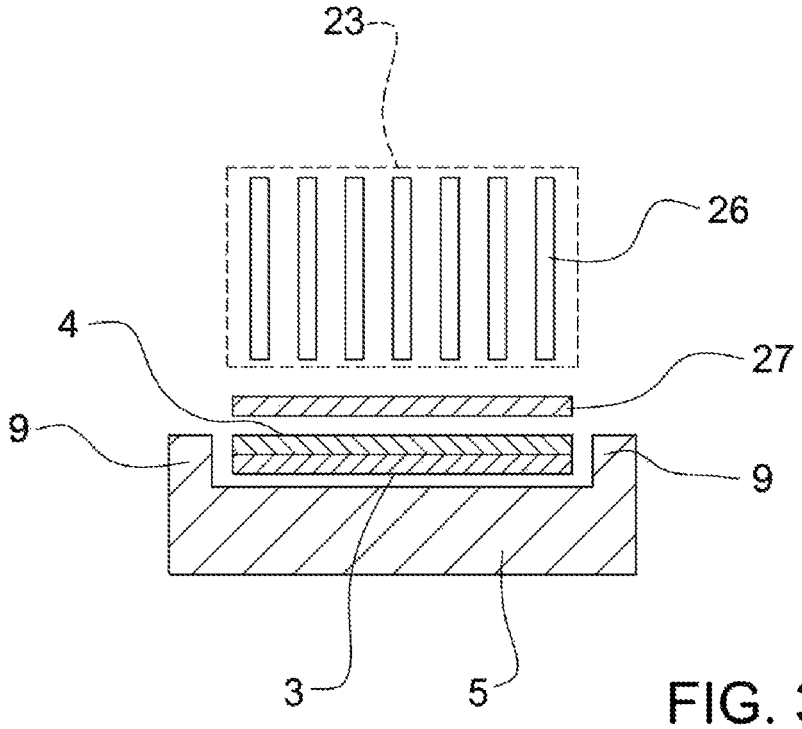
FIG. 3 is a cross-sectional view of a guide and print head of the printing mechanism.

The print head 23 has a plurality of wires 26 (see FIG. 3) with ends arranged substantially parallel and adjacent to each other. The print head 23 is arranged to heat a selected number of the wires 26 to mark the laboratory slide 2.

A thermal tape 27 is placed between the print head 23 and the marking location 24 and is arranged to be moved by at least one roller 28, 29'. A roll 29 (see FIG. 4) of the supplied thermal tape is mounted on a biased arm 30 that moves as the size of the roll decreases. An arm position sensing means 31 is mounted adjacent the arm 30 to sense movement of the biased arm 30 as the roll 29 changes in size. The arm position sensing means 31 comprises a series of optical sensors 31*a*, 31*b*, 31*c* that the arm 30 moves past. A light indicator means 54 indicates the status of the amount of tape 27 in the roll 29. An encoder 32 (see FIG. 5) controls movement of the tape 27 during a printing operation. The thermal tape 27 is taken up by roller 29'.

The apparatus 1 further includes a selectively deployable slide input or entry latch or second stop 33 for stopping the travel of a laboratory slide 2 from the entry location 6 to the marking location 24. The latch 33 is mounted in a slide entry latch opening 34 in the inclined surface 8 and is pivoted about an axle 35 in the opening 34. A spring 36 mounted in the guide 5 to one side of the axle 35 and upstream of the axle 35 (in the direction of travel of the slide 2 from the entry location 6 to the exit location 7) biases the slide entry latch 33 to a deployed or closed position shown in FIGS. 7 and 8. The end of the latch 33 downstream of the axle 35 has a protrusion 37 which extends beneath or on a rear side of the guide 5 for engagement by a bevel 38 extending from the carriage block 12. The bevel 38 is positioned near the actuator shaft pivot connection 20.

A first optical sensor 39 is mounted in a first optical sensor opening 40 in the inclined surface 8 of the guide 5. The first optical sensor opening 40 is adjacent and to one side of the slide entry latch opening 34.

The apparatus 1 further includes a selectively deployable slide exit latch or first stop 41 for arresting the travel of a laboratory slide 2 down the guide 5 at the marking location 24. The latch 41 is mounted in a slide exit latch opening 42 in the inclined surface 8 and is pivoted about an axle 43 in the opening 42. A spring 44 mounted in the guide 5 to one side of the axle 43 and downstream of the axle 43 biases the slide exit latch 41 to a deployed or closed position shown in FIGS. 6 and 7. The end of the latch 41 upstream of the axle 43 has an arm 45 which extends beneath or on a rear side of the guide 5 and the arm 45 has a protrusion 46 at its distal end facing the carriage block 12, for engagement by the carriage block 12.

A second optical sensor 47 is mounted in a second optical sensor opening 48 in the inclined surface 8 of the guide 5. The second optical sensor opening 48 is just upstream of the slide exit latch 41.

A barcode reader 49 is mounted above the guide 5 between the slide exit latch 41 and the exit location 7.

An electronic control processor 50 (see FIG. 5) is connected to the carriage block stepper motor 14, the linear actuator shaft stepper motor 18, the print head 23, the tape roller 29', the roll arm sensing means 31, the encoder 32, the first and second optical sensors 39, 47, the barcode reader 49, and the light indicator means 54 for the roll 29 of thermal tape 27. The processor 50 is also connected to data input means 51 wherein data for printing on a laboratory slide 2 is input into the apparatus 1. The data input means 51 may comprise, for example, a barcode scanner, a network hub, a USB memory device and/or a touch screen 51*a* (see FIG. 1).

The process of marking a laboratory slide 2 with the apparatus 1 will now be described.

Referring to FIGS. 6 to 8, the slide exit latch 41 is in its deployed position. The linear actuator shaft stepper motor 18 shown in FIG. 6 has the linear actuator shaft 19 in a retracted position so that the print head 23 is away from the marking location 24. The carriage block stepper motor 14 positions the carriage block 12 along the rail 11 so that the bevel 38 of the carriage block 12 engages the slide entry latch protrusion 37. This causes the slide entry latch 33 to rotate around its axle 35 so as to compress the spring 36 and place the slide entry latch 33 in an undeployed position so that a laboratory slide 2 can travel from the entry location 6 to the marking location 24.

A laboratory slide 2 is dropped into the entry location 6 by hand or by a mechanical delivery unit (not shown) and slides down the inclined surface 8 of the guide 5 temporarily blocking a beam of light produced by a light source 39' (see FIG. 2) to be detected by the first optical sensor 39. This causes the first optical sensor 39 to send a signal to the processor 50 indicating that a slide 2 has entered the apparatus 1. The slide 2 continues to slide down the inclined surface 8 until it comes to rest against the deployed slide exit latch 41 so that the slide 2 is in the marking location 24 (see FIG. 7). The deployed latch 41 thus blocks travel of the slide 2 and supports it.

The laboratory slide 2 should be placed in its correct orientation in the marking location 24 wherein its marking surface 4 is distal from the deployed slide exit latch 41 and facing the print head 23. If the laboratory slide 2 has been placed in the marking location 24 so that its marking surface 4 is adjacent the deployed slide exit latch 41, the marking surface 4 will block a beam of light produced by a light source 47' (see FIG. 2) to be detected by the second optical sensor 47. This indicates that the laboratory slide 2 has been placed in an incorrect orientation at the marking location 24 and triggers an eject sequence or process. In this eject sequence, the processor 50 activates the carriage block stepper motor 14 to move the carriage block 12 along the rail 11 until a bottom end of the carriage block 12 engages the slide exit latch protrusion 46. This causes the slide exit latch 41 to rotate around its axle 43 so as to compress the spring 44 and place the slide exit latch 41 in an undeployed position so that the incorrectly orientated laboratory slide 2 is ejected by falling from the marking location 24 and out of the apparatus 1 via the exit location 7.

If the processor 50 has received a signal from the first optical sensor 39 that a laboratory slide 2 has entered the apparatus 1 and that the received laboratory slide 2 has not been ejected for being incorrectly orientated, then the carriage block 12 is moved so that its bevel 38 no longer engages the slide entry latch protrusion 37 enabling the slide entry latch 33 to return to its deployed position, blocking any further slides 2 from entering the marking location 24 as shown in FIG. 7. The linear actuator shaft 19 is extended so that the carriage block pivot arm spring 21, which biases the print head 23 towards the marking location 24 in the first direction 25, rotates the pivot arm 16. Consequently, the print head 23 presses the thermal tape 27 against the slide 2 (see FIGS. 2 and 3) so that the tape 27 is pinched between the print head 23 and the slide surface. The slide 2 is thus pressed against the inclined surface 8 and is under little or effectively no stress. Due to the fact that the T-shaped piece 20 at the end of the actuator shaft 19 is accommodated in the U-shaped slot 12' in the carriage block 12, the force with which the print head 23 is urged against the tape 27 and the slide 2 is determined by the force of the spring 21 not by the force exerted by the actuator shaft 19 which is driven by the stepper motor 18.

The processor 50 receives data from the data input means 51 for a mark in the form of a barcode to be printed on the marking surface 4 of the laboratory slide 2. Selected wires 26 of the print head 23 are heated by being energised for a given time and a given power to produce a first line of the mark on the marking surface 4 of the slide 2. The time and power are stored in a memory 53 (see FIG. 5) of the processor 50. The carriage block 12 is then moved along the second direction 15 towards the exit location 7 a small distance corresponding to the diameter of a said wire 26 and selected wires 26 are heated to produce a second line of the mark on the marking surface 4 of the slide 2. The processor 50 controls the amount of heat applied to any selected wire 26 taking into account calculated residual heat of that wire 26 from previous use of that wire 26 by accessing the times and power stored in the memory 53. This process is repeated until the required barcode 55 is printed on the slide 2.

The linear actuator shaft 19 is then retracted compressing the carriage block pivot arm spring 21 and the print head 23 is moved in the first direction 25 away from the slide 2. The slide 2 is ejected from the apparatus 1 by the carriage block 12 being moved to engage the slide exit latch protrusion 46 so that the slide exit latch 41 is retracted to its undeployed position (see FIG. 8).

As the marked laboratory slide 2 falls from the marking location 24 it passes the barcode reader 49. If the barcode reader 49 can read the barcode 55 printed on the slide 2 then the read barcode 55 is verified by the processor 50. If the barcode reader 49 cannot read the barcode 55 then the processor 50 provides a signal or message that the printing of the slide 2 has failed. A user of the apparatus 1 can then have the printing process repeated.

The carriage block 12 is then moved upwardly away from the slide exit latch 41 to the position shown in FIG. 6 so that the slide exit latch 41 returns to its deployed position. The bevel 38 of the carriage block 12 engages the slide entry latch protrusion 37 so that the slide entry latch 33 is placed in its undeployed position. The thermal tape 27 is moved or wound on by the rollers 28 so that a fresh section of tape 27 is ready to be used for the next printing operation. Another laboratory slide 2 is then dropped into the apparatus 1 for printing.

Figure 4:
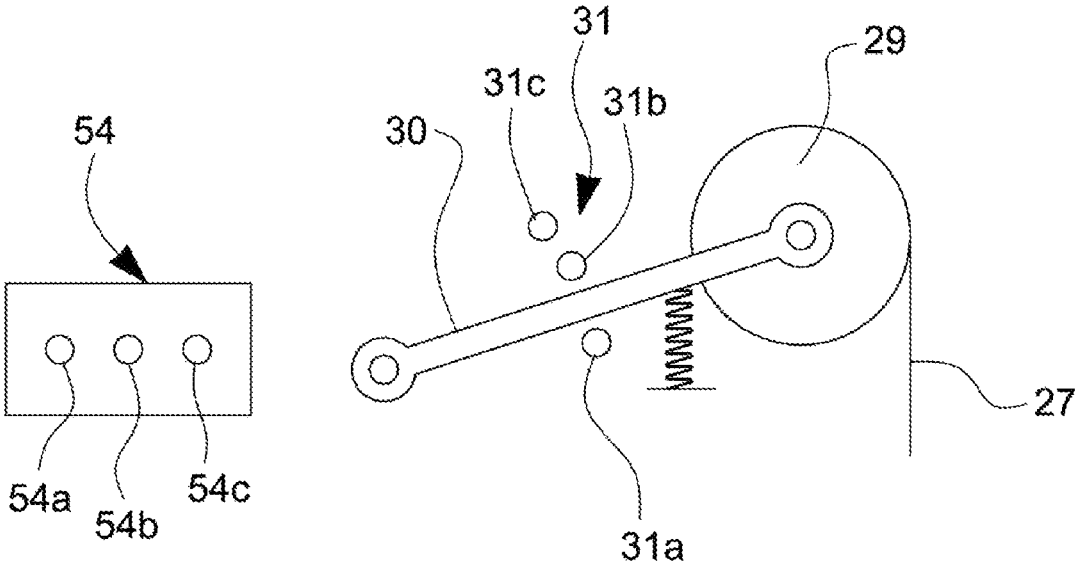
FIG. 4 is a view of a means of monitoring a roll of thermal tape for the printing mechanism.
Figure 5:
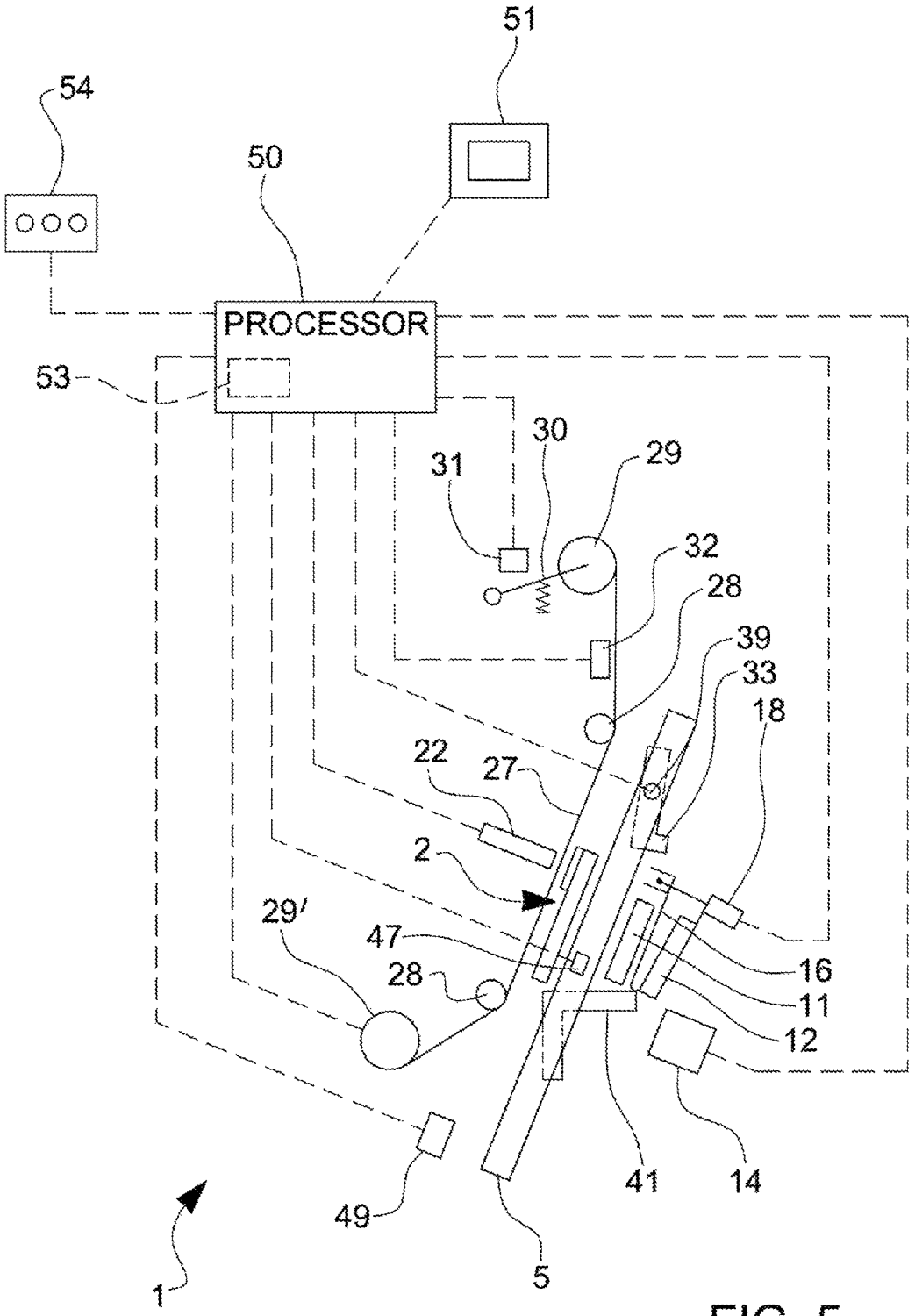
FIG. 5 is a view of the apparatus showing a control processor.

Referring to FIG. 4, if the thermal tape roll arm sensing means 31 senses sufficient movement of the biased arm 30 to indicate that the roll 29 of tape 27 is running out then the processor 50 provides a signal to this effect. A green light 54*a* of the light indicator means 54 is illuminated to indicate that there is plenty of tape 27 left when the arm 30 is detected by the first 31*a* of the series of three optical sensors of the arm sensing means 31, an amber light 54*a* of the light indicator means 54 is then illuminated to indicate that the tape 27 has nearly run out when the arm 30 is detected by the second optical sensor 31*b*, and a red light 54*a* of the light indicator means 54 is illuminated to indicate that a new roll 29 of thermal tape 27 should be placed in the apparatus 1 when the arm 30 is detected by the third 31*c* and last of the sensors. If the tape 27 runs out during a printing operation then no movement would be detected by the encoder 32 and the processor 50 provides a signal or message that the tape 27 has run out.

Referring to FIGS. 9 to 14, an apparatus 60 for marking a laboratory sample carrier according to a second embodiment of the invention is illustrated wherein the laboratory sample carrier is a glass or plastic phial 61 comprising a cylindrical body 62 with a rectangular writing patch 63 on the body 62.

The guide 64 for the apparatus 60 forms a channel shaped to guide a phial 61 from the entry location 65 to the exit location 66. The channel 64 has a longitudinal axis 67 and has an arc shape in cross-section (only one half of the channel to one side of the longitudinal axis 67 is shown in FIG. 9). The angle θ of incline of the guide is similar to that given in the first embodiment such that a phial 61 can travel from the entry location 65 to the exit location 66 under the influence of gravity but without tipping forward.

The first optical sensor 68 is mounted in the first optical sensor opening 69 which is in the bottom of the channel 64 wherein the bottom is parallel to the longitudinal axis 67 of the channel 64.

The apparatus 60 includes a pivot arm 70 arranged to pivot about a pivot point 71. One end of an actuator shaft 72 is connected by a pivot connection 73 to a connector 74 slidable along the arm 70 and the actuator shaft 72 is arranged to be actuated by a stepper motor 75.

The print head 76 is fixed to the distal end of the pivot arm 70. The ends of the wires (not shown) of the print head 76 are arranged to be aligned with an opening 77 in the bottom of the channel 64. The thermal tape 78 (see FIGS. 10 and 14) passes through the opening 77 and is perpendicular to the longitudinal axis 67 of the channel 64. The thermal tape 78 is guided by a pair of tape rollers 79 wherein each one of the tape rollers 79 is on an opposite side of the longitudinal axis 67. The marking location 80 is above the tape 78 in the bottom of the channel 64 and the print head 76 is below the tape 78.

The selectively deployable second stop 81 is a mechanical stop for stopping the travel of a phial 61 from the entry location 65 to the marking location 80. The second stop 81 is actuated by a solenoid 82 or a motor between an undeployed position and a deployed position.

The apparatus 60 further includes a phial holder 83 comprising a pair of selectively deployable phial holding portions 84. Each phial holding portion 84 comprises an upper holding arm 85 and a lower holding arm 86 wherein the arms 85, 86 are spaced apart along an axle 87 parallel to the longitudinal axis 67. The arms 85, 86 curve inwardly about the longitudinal axis 67 and the lower holding arm 86 has a tab 88 or stop feature distal from the axle 87 wherein the tab 88 of each lower arm 86 face each other. These tabs 88 form first or bottom stops for arresting the travel of a phial 61 down the guide 64 at the marking location 80. The arms 85, 86 are rotatable towards and away from the marking location 80 and are spring mounted or loaded about the axles 87. Each arm 85, 86 is held between a pair of flanges 102 (only lower one is shown in FIG. 13) extending from the axle 87 and a spring 103 connects the arm 85, 86 to the axle 87. Phial drive rollers 89 are mounted on the axle 87 between the arms 85, 86 and are rotatable about the axle 87 by means of a phial drive rollers rotator 90. The phial drive rollers rotator 90 (see FIG. 10) comprises a motor 91 that rotates wheels 92 on arms 93 wherein the rotator 90 is moved so that the wheels 92 engage the phial drive rollers 89 to rotate them. A free running roller 94 is mounted between the end of the arms 85, 86 distal from the axle 87. The axle 87 extends beyond the lower arm 86 and has a cog 95 mounted on it by which the axle 87 is rotated. Each cog 95 engages another cog 96 that engages a rack 97 which is connected to the print head 76.

The electronic control processor 98 (see FIG. 14) is connected to the print head pivot arm stepper motor 75, the print head 76, the second stop solenoid 82, and the phial drive rollers rotator 90. The processor 98 is also connected to the tape roller 99 for moving the tape 78. In addition, the processor 98 is connected to the first optical sensor 68 for sensing when a phial 61 has entered the apparatus 60 and to the second optical sensor 100 for sensing that a writing patch 63 on a phial 61 is in the correct position when the phial 61 is in the marking location 80. The processor 98 is also connected to a third optical sensor 101 for detecting the phial 61 as it exits the apparatus 60.

The process of marking a phial 61 with the apparatus 60 will now be described.

The pair of phial holding portions 84 are in their deployed or rest position (see FIG. 15) wherein the tabs 88 of the lower arms 86 are positioned to arrest the travel of a phial 61 down the channel 64. The print head pivot arm stepper motor 75 (see FIG. 14) has the actuator shaft 72 in a retracted position so that the print head 76 is away from the marking location 80. The electronic control processor 98 controls the solenoid 82 so that the second stop 81 is in an undeployed position enabling a phial 61 to travel from the entry location 65 to the marking location 66.

A phial 61 is dropped into the entry location 65 and slides down the channel 64 wherein the first optical sensor 68 detects that a phial 61 has entered the apparatus 60. The phial 61 continues to slide down the channel 64 until it comes to rest against the tabs 88 of the lower arms 86 of the deployed phial holding portions 84 so that the phial 61 is in the marking location 80.

The electronic control processor 98 then activates the solenoid 82 to move the second stop 81 into its deployed position blocking any further phials from entering the marking location 80. The processor 98 also activates the print head pivot arm stepper motor 75 to move the print head 76 towards the phial 61. This movement moves the racks 97 (see FIG. 10) as well so that the phial holding portions 84 are rotated towards each other via the cogs 95, 96 until they reach a patch location position (see FIG. 16) wherein the free rollers 94 and the drive rollers 89 of the phial holding portions 84 engage the phial 61.

The second optical sensor 100 is mounted to locate an edge of the writing patch 63 and the electronic control processor 98 causes the drive rotator 90 to rotate the phial drive rollers 89 so that the phial 61 is rotated up to one complete revolution. If the second optical sensor 100 detects the edge then the phial drive rollers 89 are stopped so that an opposite edge of the rectangular writing patch 63 is aligned with the print head 76 and the apparatus 60 is ready for printing on the writing patch 63 of the phial 61. If the second optical sensor 100 has not detected an edge of a writing patch 63 of a phial 61 after the phial 61 has been rotated through one revolution then the phial 61 is deemed not to have a writing patch and printing can begin on the surface facing the print head 76 to ensure that some form of marking is provided.

The stepper motor 75 extends the actuator shaft 72 so that the print head 76 presses the thermal tape 78 against the phial 61 (see FIG. 11). The print head 76 is now in a print position wherein the tape 78 is pinched between the print head 76 and the phial surface (see FIG. 10). The movement of the print head 76 causes the racks 97 to rotate the axles 87 but since the arms 85, 86 are spring mounted on the axles 87 the arms 85, 86 will not rotate any further towards each other as the drive and free rollers 89, 94 already engage the phial 61 and the springs 103 of the spring mounted arms 85, 86 are simply compressed.

The processor 98 then causes the tape moving roller 99 and the phial drive rollers 89 to rotate so that the tape 78 and phial 61 rotate at the same speed with the print head 76 printing on the writing surface 63 of the phial 61 whilst the print head 76 remains stationary. The tape moving roller 99 and the phial drive rollers 89 are driven at the same pitch as the resolution of the print head 76 which in a preferred embodiment is 118 dots per cm (300 dpi).

When printing is finished an eject sequence is triggered. The processor 98 activates the stepper motor 75 to retract the actuator shaft 72 so that the print head 76 is moved away from the marking location 80 causing initially the springs of the spring mounted arms 85, 86 to become uncompressed. Further movement of the print head 76 causes the phial holding portions 84 to rotate away from each other until they reach a phial eject position (see FIG. 17) wherein the tabs 88 of the lower arms 86 are no longer beneath the phial 61. The phial 61 consequently falls from the marking location 80, which is detected by the third optical sensor 101, and out of the apparatus 60 via the exit location 66.

The print head 76 is then moved back towards the marking location 80 until phial holding portions 84 are rotated into their deployed or rest position, and the second stop 81 is moved to its undeployed position so that another phial 61 can be dropped into the apparatus 60 for printing.

The phial drive rollers 89 may rotate the phial 61 in steps. Also, the tape 78 may be moved in steps.

The apparatus 60 for marking a phial may include means for biasing the print head 76 towards the marking location 80. The apparatus 60 may also include an actuator arranged to counter the biasing means to move the print head 76 away from the marking location 80.

In a modification to the second embodiment, the phial holding portions 84 may be engaged by a rotatable cam that is driven by a motor controlled by the electronic control processor 98 and rotation of the phial holding portions 84 is independent of movement of the print head 76. When printing is finished the print head 76 is moved, say, less than 1 mm from the phial 61 and the phial holding portions 84 are rotated away from each other until they reach the phial eject position.

It only takes a few seconds for the slide 2 or phial 61 to pass through the apparatus 1, 60 and be marked in the process.

Although a barcode 55 has been described as being printed on a laboratory slide 2, the apparatus 1, 60 may be used to print any suitable mark on the slide 2 or phial 61.

Whilst particular embodiments have been described, it will be understood that various modifications may be made without departing from the scope of the invention. For example, any suitable form of roll arm sensing means 31 and light indicator means 54 may be used.

The invention claimed is:

1. An apparatus (1) for marking a laboratory sample carrier (2), including:

(i) a guide (5) configured to guide a sample carrier (2) from an entry location (6) to an exit location (7); and (ii) a marking apparatus (23) configured and positioned to mark a sample carrier (2) at a marking location (24) at a guide position intermediate the entry and exit locations (6, 7), wherein the guide (5) is vertical or inclined such that a sample carrier (2) can travel from the entry to the exit locations (6, 7) under the influence of gravity and the apparatus (1) further includes a selectively deployable first stop (41) for arresting the travel of a sample carrier (2) down the guide (5) at the marking location (24), the first stop (41) being undeployable to allow the sample carrier (2) to travel from the marking location (24) to the exit location (7).

2. The apparatus as claimed in claim 1, including a first sensor (39) that senses that a said laboratory sample carrier (2) has entered the apparatus (1).

3. The apparatus as claimed in claim 1, including a tape positioning member between the marking apparatus (23) and the marking location (24).

4. The apparatus as claimed in claim 1, including a selectively deployable second stop (33) for stopping the travel of a laboratory sample carrier (2) from the entry location (6) to the marking location (24), the second stop (33) being undeployable to allow the sample carrier (2) to travel to the marking location (24).

5. The apparatus as claimed in claim 1, including a second sensor (47) that senses that the laboratory sample carrier (2) has been placed in the correct position at the marking location (24).

6. The apparatus as claimed in claim 5, wherein the first stop (41) is arranged to be undeployed when the second sensor (47) senses that the laboratory sample carrier (2) has been placed in an incorrect orientation at the marking location (24).

7. The apparatus as claimed in claim 1, including a translating member (16, 18, 19, 22) arranged to move the marking apparatus (23) in a first direction (25) towards or away from the marking location (24).

8. The apparatus as claimed in claim 7, including a moving member (11, 12, 13, 14) arranged to move the marking apparatus (23) in a second direction (15) along the guide (5) transversely to the first direction (25).

9. The apparatus as claimed in claim 8, wherein the moving member (12) is arranged to undeploy a selectively deployable second stop (33) for stopping the travel of a laboratory sample carrier (2) from the entry location (6) to the marking location (24), the second stop (33) being undeployable to allow the sample carrier (2) to travel to the marking location (24).

10. The apparatus as claimed in claim 8, wherein the moving member (12) is arranged to undeploy the first stop (41).

11. The apparatus as claimed in claim 7, wherein the translating member (75, 97) is arranged to deploy a selectively deployable sample carrier holding apparatus (84) that holds a laboratory sample carrier (61) at the marking location (80).

12. The apparatus as claimed in claim 1, including a marking apparatus biasing member (21) that biases the marking apparatus (23) towards the marking location (24).

13. The apparatus as claimed in claim 12, including an actuator (18, 19) arranged to counter the marking apparatus biasing member (21) to move the marking apparatus (23) away from the marking location (24).

14. The apparatus as claimed in claim 1, including a carriage (12) to which the marking apparatus (23) is mounted.

15. The apparatus as claimed in claim 14, including a member (38) to undeploy said first stop (33) mounted to move with the carriage (12).

16. The apparatus as claimed in claim 1, including a selectively deployable sample carrier holding apparatus (84) that holds a laboratory sample carrier (61) at the marking location (80).

17. The apparatus as claimed in claim 16, wherein the sample carrier holding apparatus comprises a pair of sample carrier holding portions (84) arranged to be deployed by being rotated towards the marking location (80) and arranged to be undeployed by being rotated away from the marking location (80).

18. The apparatus as claimed in claim 16, wherein the first stop (86, 88) comprises part of the sample carrier holding apparatus (84).

19. The apparatus as claimed in any claim 16, wherein the sample carrier holding apparatus (84) includes a mechanism (89) for rotating the laboratory sample carrier (61) at the marking location (80).

20. The apparatus as claimed in claim 19, wherein the sample carrier holding apparatus rotating mechanism (89) is arranged to rotate the laboratory sample carrier (61) when the marking apparatus (76) is positioned to mark the laboratory sample carrier (61).

* * * * *